United States Patent [19]

Itai et al.

[11] 4,139,752

[45] Feb. 13, 1979

[54] GAS-TYPE CIRCUIT-BREAKER

[75] Inventors: Kosaku Itai; Yoshihiro Ueda, both of Amagasaki, Japan

[73] Assignee: Mitsubishi Denki Kabushiki Kaisha, Tokyo, Japan

[21] Appl. No.: 679,597

[22] Filed: Apr. 23, 1976

[30] Foreign Application Priority Data

May 30, 1975 [JP] Japan ..... 50/65951

[51] Int. Cl.[2] ..... H01H 33/82; H01H 33/00

[52] U.S. Cl. ..... 200/148 R; 200/148 A; 200/148 C; 200/148 G

[58] Field of Search ..... 200/148 A, 148 R, 144 R, 200/150 RD, 148 C

[56] References Cited

U.S. PATENT DOCUMENTS

| | | | |
|---|---|---|---|
| 3,010,003 | 11/1961 | Pucher | 200/150 RD |
| 3,045,087 | 7/1962 | Duffing | 200/150 RD |
| 3,100,248 | 8/1963 | Forwald | 200/150 RD |
| 3,641,295 | 2/1972 | Ferton et al. | 200/148 A |
| 3,659,065 | 4/1972 | Roidt et al. | 200/148 A |
| 3,985,988 | 10/1976 | Korner et al. | 200/148 A |

FOREIGN PATENT DOCUMENTS

| | | | |
|---|---|---|---|
| 1540177 | 1/1970 | Fed. Rep. of Germany | 200/148 A |
| 2015473 | 10/1970 | Fed. Rep. of Germany | 200/148 A |
| 2025054 | 1/1971 | Fed. Rep. of Germany | 200/148 A |
| 317124 | 12/1971 | U.S.S.R. | 200/144 R |

*Primary Examiner*—Robert S. Macon
*Attorney, Agent, or Firm*—W. A. Elchik

[57] ABSTRACT

An improved gas-type circuit-interrupter is provided having a pair of separable contacts, which establish an arc upon separation within a confined casing having a nozzle structure. The arrangement is such that during the initial portion of the opening operation of the interrupter, the established arc generates gas pressure, due to the hot arc energy developed in the arc, and this high-pressure gas is then stored within an adjacently-provided gas-storage region. At a later point in time in the opening operation, when, preferably, the current flow through the interrupter approaches its low instantaneous-current value, the aforesaid accumulated gas pressure, contained within said gas-storage region, returns in a gas flow to the arc, and effects the extinction thereof during such low instantaneous values of arcing current.

As an auxiliary piece of equipment, a mechanically-operated gas-puffer device, including an operating cylinder movable, for example, over a stationary piston structure generates additional augmenting gas pressure, which assists the aforementioned high-pressure gas stored and accumulated within the aforesaid gas-storage region.

In yet a further embodiment, one-way-acting valves, associated with the aforesaid gas-piston chamber, prevent entrance, or flow of the piston-generated gas within the piston chamber until the gas pressure within the piston chamber drops to a predetermined extent within the nozzle-structure interrupting region ofthe substantially-confined casing.

10 Claims, 11 Drawing Figures

CLOSED POSITION

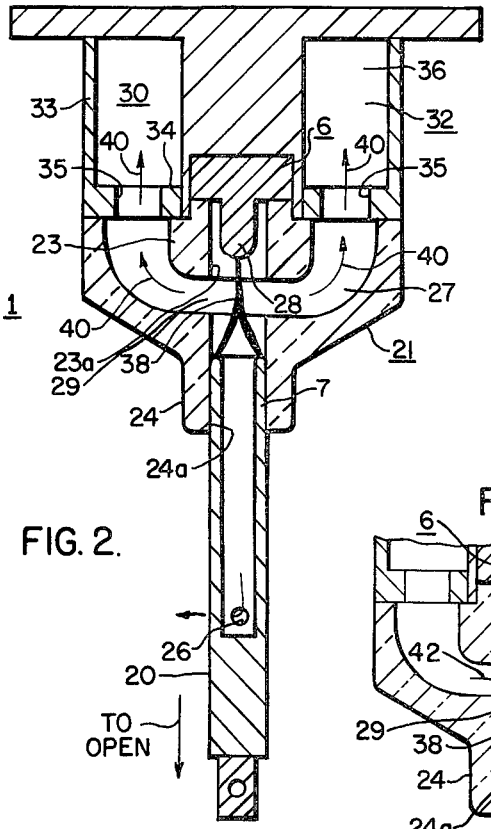
FIG. 2.
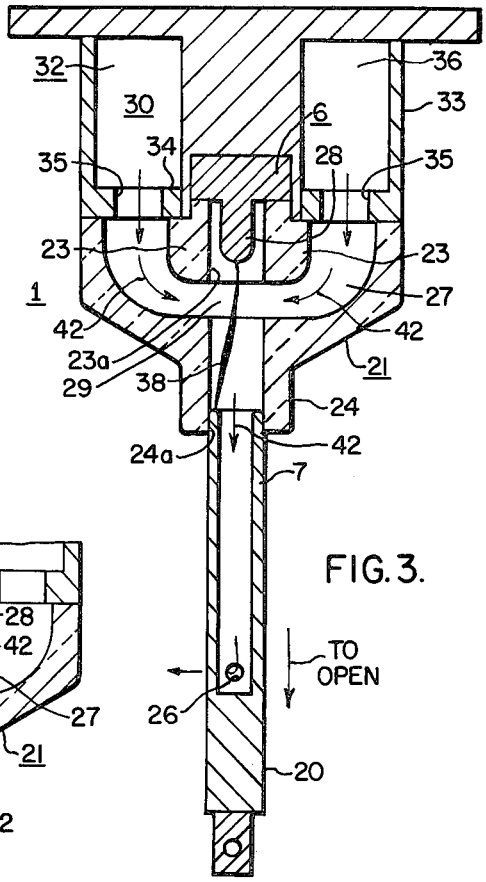
FIG. 3.
FIG. 3A.
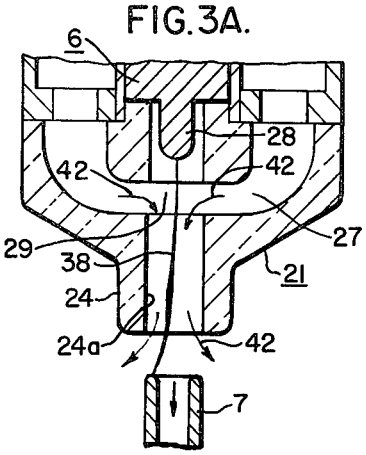
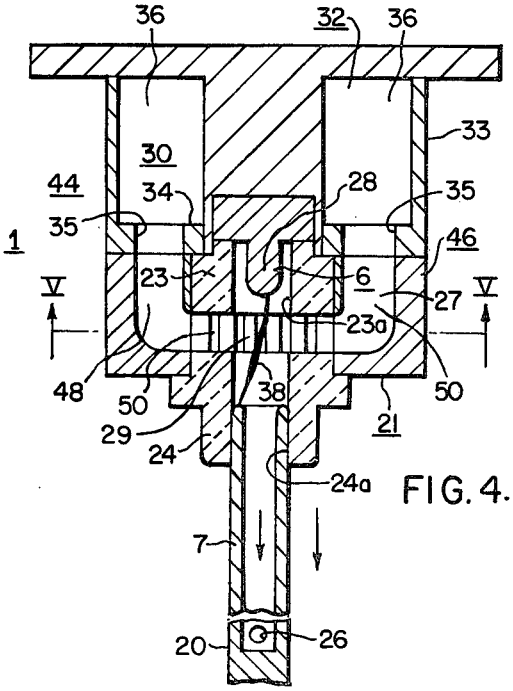
FIG. 4.
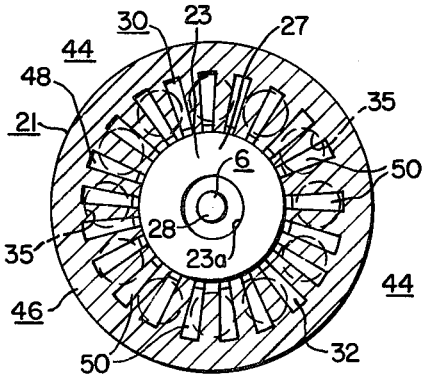
FIG. 5.

CLOSED POSITION

PARTIALY OPEN

PARTIALY OPEN

CLOSED POSITION

GAS-TYPE CIRCUIT-BREAKER

CROSS-REFERENCES TO RELATED APPLICATIONS

Applicants are not aware of any related patent applications pertinent to the present invention.

SUMMARY OF THE INVENTION

According to the instant invention, there is provided a substantially-confined casing structure having a hollow-nozzle orifice member associated therewith, through which the movable tubular venting contact projects in the closed-circuit position. During the initial portion of the opening operation of the interrupter, said tubular venting movable contact makes contacting engagement with the stationary contact, establishing, during opening, an arc within the confined casing structure, with the movable venting contact blocking the hollow orifice opening. During high-instantaneous values of arcing current, the heat of the arc energy raises the gas pressure within the substantially-confined casing, and causes it to be stored within a conveniently and adjacently-located gas-storage region. At a subsequent point in time during the opening operation of the interrupter, the gas, stored within the gas-storage region, returns in a reverse-flow manner to the nozzle structure to effect extinction of the drawn arc at low instantaneous values of arcing current, the gas passing through the hollow tubular venting contact.

For certain applications, a cooling structure, such as a metallic heat sink, for example, having radially-projecting metallic vanes, may be utilized to effect a cooling of the compressed gas during its passage into the gas-storage region, and also during its return path out of said gas-storage region, so that later in point of time relatively-cool gas strikes the drawn arc when the latter has attained its relatively-low instantaneous values of arcing current.

As an additional interrupting structure, resort may be had to a mechanically-operated puffer device, including a relatively-movable operating cylinder and a relatively-stationary piston structure, for example, to generate an additional augmenting source of gas flow during the opening operation of the circuit-breaker. Preferably, the mechanical actuating device, associated with such a puffer structure, may be synchronized with the operating mechanism for effecting the opening of the movable contact structure, in fact, being the same operating rod.

In connection with the aforesaid puffer structure, for certain applications, a one-way-acting valve structure may be associated with the piston chamber to prevent the ejection of compressed gas out of the said piston chamber until the pressure has adequately dropped within the nozzle-interrupting area close to the position of the established arc.

BRIEF DESCRIPTION OF THE DRAWINGS

FIG. 2 is a fragmentary view, similar to that of FIG. 1, with the outer casing structure, however, eliminated, and the separable contact structure being separated during the initial portion of the opening operation of the circuit-breaker, when the heat of the arc energy generates pressure within the ambient gas, and forces the latter gas to move into the gas-storage area;

FIG. 3 illustrates the arcing conditions at a later point of time, during the opening operation, when the drawn arc is of a greater length, and the arcing current has dropped to relatively-low instantaneous values of arcing current, the figure showing the reversal of gas flow out of the gas-storage region;

FIG. 3A is a fragmentary view of a latter position of the movable contact during the opening operation;

FIG. 4 illustrates, in vertical section, a modified-type of structure, similar to that set forth above in FIGS. 1–3, but illustrating the adaptation of a heat sink or cooling device, shown as constituting a metallic device having radial inwardly-projecting metallic cooling fins, the figure showing the separated contact structure during the time when the arcing current has dropped to relatively-low instantaneous current values;

FIG. 5 is an inverted plan sectional view taken substantially along the line V—V of FIG. 4;

DESCRIPTION OF THE PREFERRED EMBODIMENTS

The present invention is particularly concerned with an improved gas-type circuit-breaker having an arc-extinguishing ambient gas, such as sulfur-hexafluoride ($SF_6$) gas, for example, contained within a gas-sealing chamber in which the circuit-breaker structure includes a pair of separable contact members, and comprises an enclosure for enclosing the contact members when one of said contact members separates away from the other cooperable contact member in moving a predetermined distance, thereby to temporarily accumulate gas expanded under pressure to be put in a high-pressure state, due to the heat generated at the arc occurring between the separable contact members.

Particularly, the invention relates to a circuit-breaker employing $SF_6$ gas, for example, which is noted for its good arc-extinguishing characteristics, and more particularly for certain embodiments generating gas under pressure to be used in extinguishing the arc. The present invention is, moreover, particularly adapted for a single-pressure-type gas circuit-breaker. During the occurrence of an arc, developed across the separable contact members in said circuit-breaker during the opening operation, the arc-extinguishing gas is raised in pressure by means of the energy developed by the heat of the arc, and such gas under pressure is confined within a gas chamber suitably prepared therefor. At a time point, during the arcing-current wave, when the arc current decreases in value, that is having a relatively-low instantaneous current-amperage value, at this the reversely gas, so confined within the gas-storage chamber, reversely flows back into the arcing area, with a concomitant reverse gas flow, the arc then being struck by said returned gas flow, and thus the arc is thereby extinguished.

The present invention, as applied for certain circuit-interrupter applications, provides an arc-extinguishing chamber eliminating the necessity of providing a conventional separately-operated puffer device, yet nevertheless having good arc-extinguishing performance.

Figure 1:
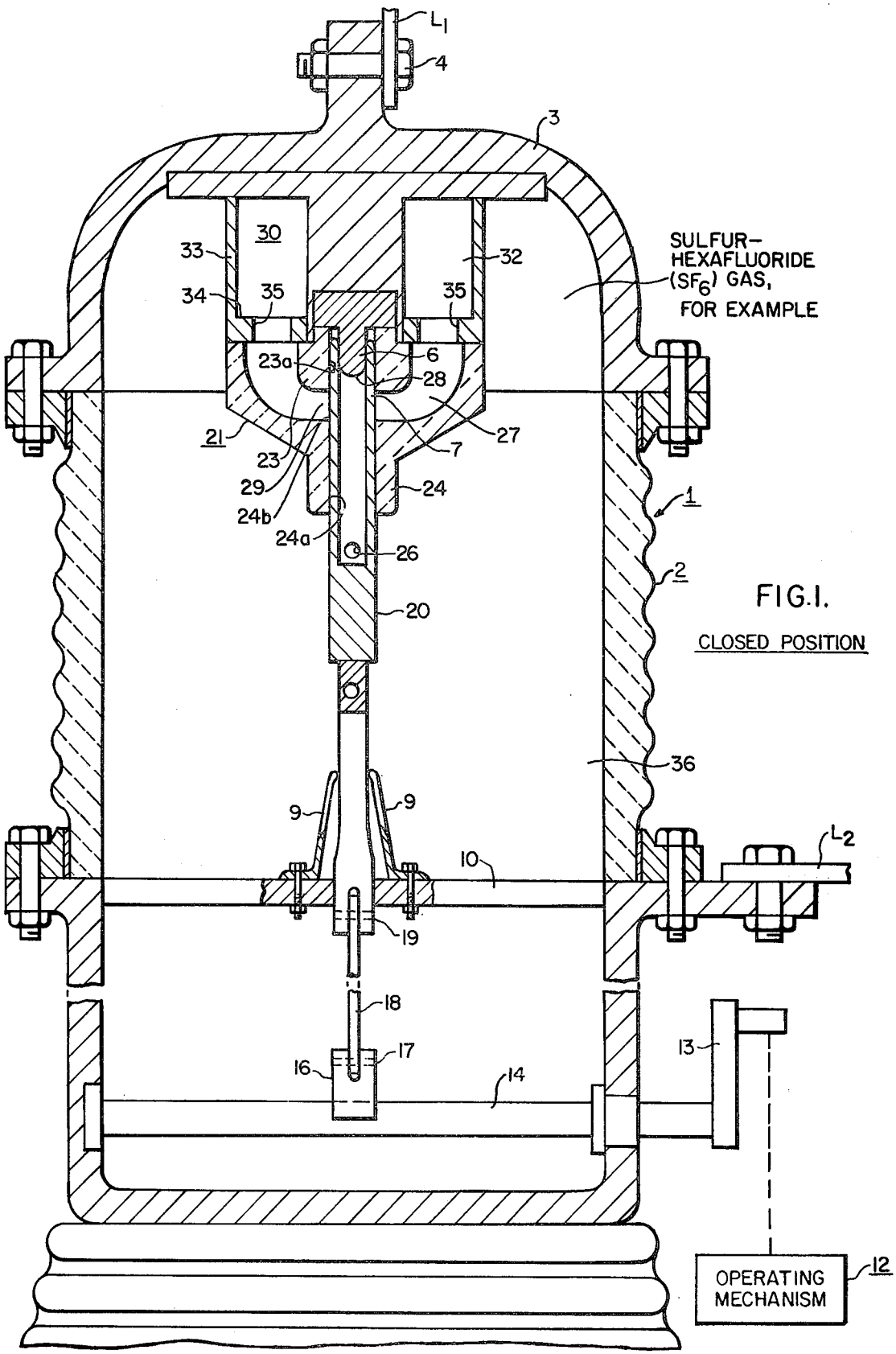
FIG. 1 is a vertical sectional view taken through one embodiment of the present invention, the contact structure being illustrated in the closed-circuit position.

With reference to FIGS. 1, 2 and 3, it will be observed that there is provided a puffer-type compressed-gas circuit-interrupter 1 having an upstanding insulating casing structure 2, which is provided at its upper end with a metallic dome-shaped conducting cap portion 3, the latter supporting, by means of a bolt 4, a line-terminal connection $L_1$. Extending downwardly interiorly of the conducting dome-shaped casting 3 within the casing structure 2 is a relatively-stationary contact structure, designated by the reference numeral 6, and cooperable in the closed-circuit position of the interrupter with a movable contact structure 7, as illustrated more clearly in FIG. 1 of the drawings. The movable contact structure 7 is electrically connected, by a plurality of sliding finger contacts 9, to a generally horizontally-extending conducting support plate 10, which provides a second line terminal $L_2$ externally of the casing 2, as again shown more clearly in FIG. 1.

A suitable operating mechanism 12 of conventional form effects rotation of an externally-provided crank-arm 13, the latter effecting opening and closing rotative motions of an internally-disposed operating shaft 14. The operating shaft 14, in turn, is fixedly connected to an internally-disposed rotative crank-arm 16, which is pivotally connected, as at 17, to a floating link 18, the latter being pivotally connected, as at 19, to the lower end of a linearly-movable contact-operating rod 20.

It will be noted that the upper end of the contact operating rod 20 forms the movable contact 7 itself, which, as mentioned hereinbefore makes contacting closed-circuit engagement with the stationary contact structure 6 in the closed-circuit position of the interrupting device 1, as illustrated in FIG. 1.

It will be observed that there is provided a substantially-enclosed, or substantially-confined arc-extinguishing casing structure 21 having a pair of axially-spaced nozzle structures 23 and 24 associated with the lower end thereof. Both axially-spaced nozzle structures 23, 24 have respective openings 23*a* and 24*a* provided therethrough, through which the movable tubular venting contact 7 moves during its vertical opening and closing movements.

As illustrated in FIG. 1, the movable tubular venting contact 7 has a laterally-provided vent hole 26, and the lower end of the movable contact 7 is connected by the operating rod 20 to the aforesaid actuating linkage 17–19.

FIG. 1 illustrates the device in the closed-circuit position, wherein the movable tubular venting contact 7 makes contacting engagement with a stationary contact structure 6 having a downwardly-projecting stationary plug portion 28 fitting within the upper open end of the movable tubular venting contact 7 in the closed-circuit position of the device illustrated in FIG. 1.

Disposed at the upper end of the substantially-confined arc-extinguishing casing 21 is an annular region 30, for example, providing a gas-storage area, generally designated by the reference numeral 32. This storage area 32 may be defined by a metallic casing structure 33 having a lower apertured plate portion 34 with a plurality of circumferentially-spaced holes 35 provided therein, through which gas 36 may pass into and out of said gas-storage region 30.

FIG. 2 illustrates the situation during the first part of the opening operation, wherein the movable tubular venting contact 7 has moved downwardly away from the stationary contact structure 6 drawing an arc 38 therebetween. At this time, the insulating gas 36, such as sulfur-hexafluoride ($SF_6$) gas, for example, is located adjacent to the arc 38, which is somewhat enclosed between the axially-spaced insulating nozzle structures 23 and 24. Therefore, the gas temperature is raised as a result of the hot arc energy, and the expansion and decomposition of the gas into molecules raises the gas pressure, whereby the gas 36 flows upwardly into the gas-storage area 30 to be accumulated therein. The arrows 40 indicate the gas flow upwardly into the upper-disposed gas-storage area 30.

However, since the arcing current varies with a commercial frequency, such as 50/60 Hz, the arc 38 becomes somewhat slender or attenuated, as indicated in FIG. 3, as the arcing current is reduced to low instantaneous current values. The temperature of the arc column 38 is lowered as the current approaches a zero point on the alternating-current wave. Thus, the gas pressure in the vicinity of the arc 38 is therefore decreased. As a result, the reverse gas blast flow 42 from the gas-storage region 30 back into the arc column 38 is effected within the insulating nozzles 23 and 24, and the condition is as illustrated in FIG. 3 of the drawings, that is, immediately before the interruption of the arc 38 by the reverse gas flow.

FIG. 3 illustrates the state of conditions appearing in the vicinity of a zero point for the arcing current 38 on the alternating-current wave, and the solid arrows 42 designate a stream of gas flow. Continued downward opening movement of the movable contact member 7 continuously moving in a downward direction, causes the gas to extinguish the arc 38, while being delivered through the laterally-provided holes 26 within the movable tubular venting contact 7, and also gas being ejected out of the orifice opening 24*a* provided at the lower end of the nozzle structure 24 as shown in FIG. 3A. This results in a termination or interruption of the arc 38.

As described above, according to the instant invention, the interrupting operation is performed by operating the movable tubular venting contact 7 alone, so that an additional operating force is decreased, as compared to the situation utilized with-prior art practice. Also, as the hot energy and force of the arc 38 itself is utilized to effect the blast of the arc-extinguishing gas 36, there is no necessity for providing a mechanism for compressing the arc-extinguishing gas, and consequently the number of component parts of the interrupter 1 may be reduced, or decreased as compared with interrupters of prior-art practice.

While the foregoing description has been made in conjunction with the fundamental principles of the present invention, an embodiment 44 will now be described, in conjunction with FIGS. 4 and 5, which embodiment 44 adds a cooling device 46 mounted adjacent the vent-channel portion 48 for the gas chamber in order to more effectively exert the arc-extinguishing gas flow upon the arc 38. When the arc current is high, and when the arc-extinguishing gas, exposed to the arc 38 is raised in pressure so as to be accumulated in the gas-storage region 30, as well as when the arc current is decreased to a low instantaneous value, the arc-extinguishing gas 36, stored in the gas-storage region 30, may readily flow through the cooling device 46 to the vent-hole portion 26 causing a flow of arc-extinguishing gas 36 through the cooling grooves 50 provided in the cooling device 46 to thereby cool the arc-extinguishing gas 36 so stored. Thus, a more effective arc-extinguishing operation is performed.

Figure 6:
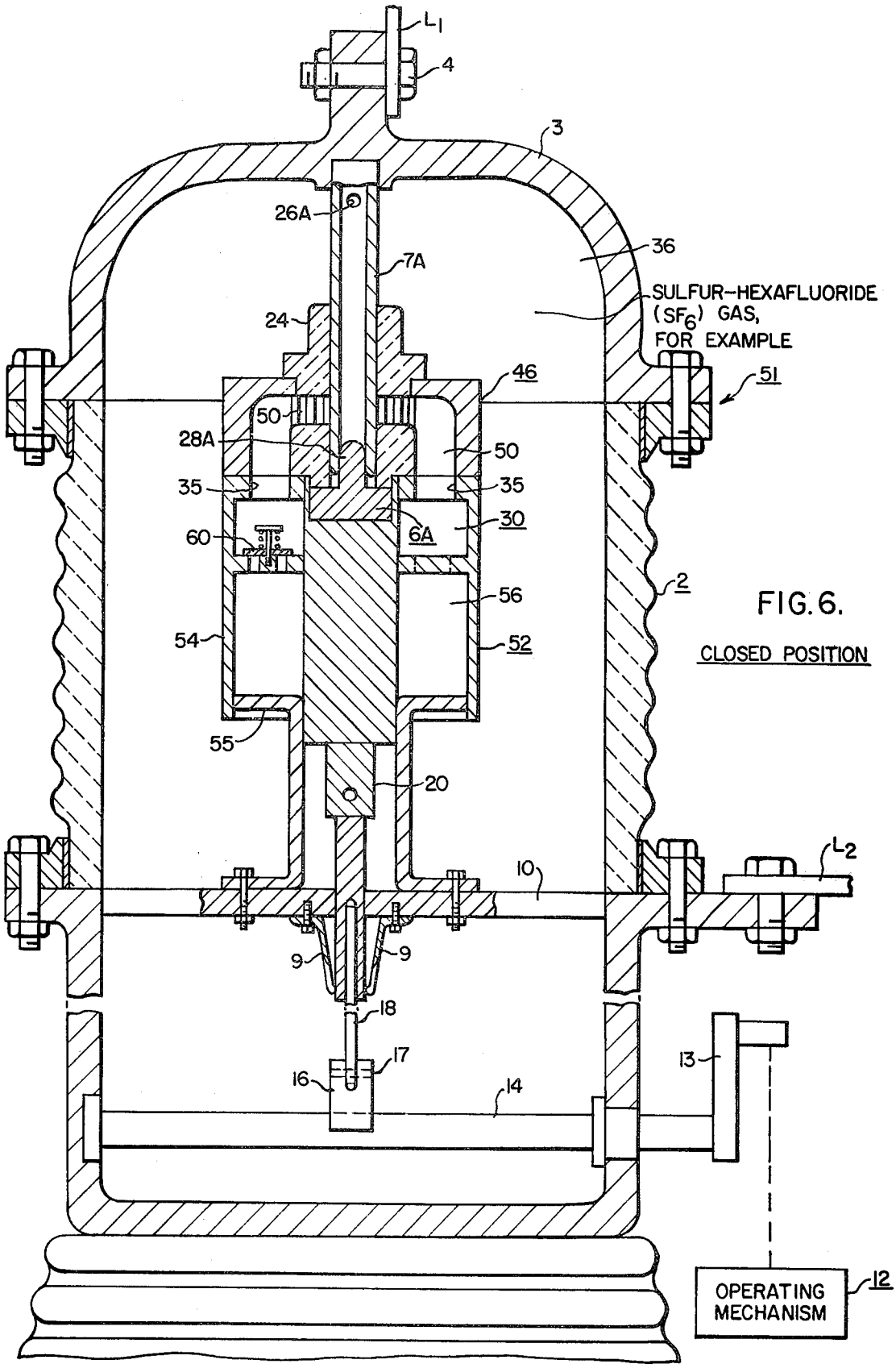
FIG. 6 illustrates a modified form of the invention, incorporating as auxiliary equipment a mechanically-operated puffer device including a relatively-movable operating cylinder and a stationary piston structure relative movement therebetween generating an auxiliary augmenting source of puffer-developed gas pressure, the separable contact structure being illustrated in the closed-circuit position.
Figure 7:
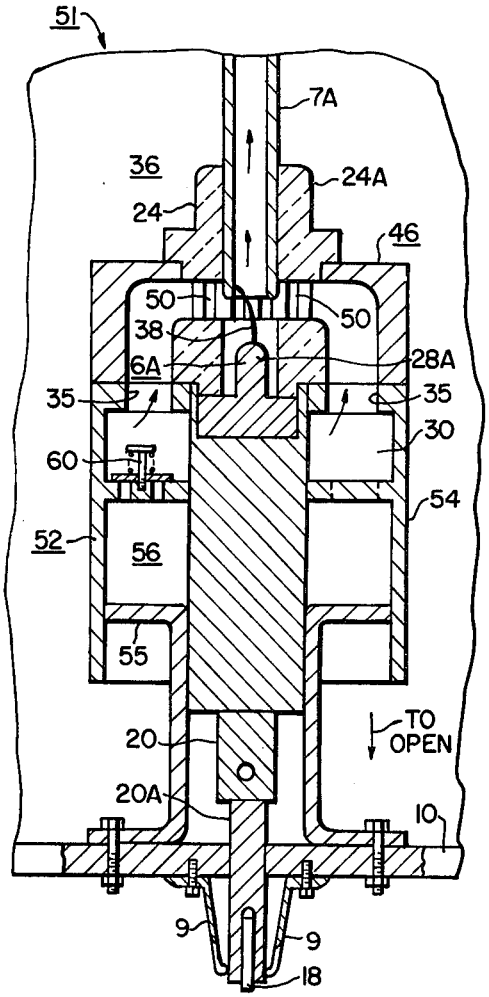
FIG. 7 is a view similar to that of FIG. 6, but showing the contacts separated during the early part of the opening stroke, when the gas pressure is accumulated within the gas-storage region and the flap valves being closed.

Further, as related to another embodiment 51, which has the characteristics as above described, and has additionally, for certain applications, a somewhat conventional puffer system 52 combined therewith, as will be described in connection with FIGS. 6 and 7. In the embodiment of FIG. 6, a construction is made such that the arc-extinguishing gas 36 is compressed by a puffer device 52 comprising a movable operating cylinder 54, which moves over a relatively-stationary piston structure 55, and is blown from the gas chamber 56 to the arc 38 through the cooling grooves 50 provided in the cooling device 46. In other words, the arc-extinguishing gas is raised in pressure with the arc energy, and is accumulated as before within the gas-storage region 30, and during the zero point of the alternating-current wave, such gas unites with the arc-extinguishing gas, compressed by means of the separate puffer device 52, to effect extinction of the arc 38.

Also, by separating the gas chamber 56 from the puffer chamber 30 by a check-valve construction 60, a resultant arrangement is made, such that the blast is additionally intensified only when the pressure within the puffer chamber 56 has a higher gas pressure than the gas pressure existent within the gas-storage region 30.

Figure 9:
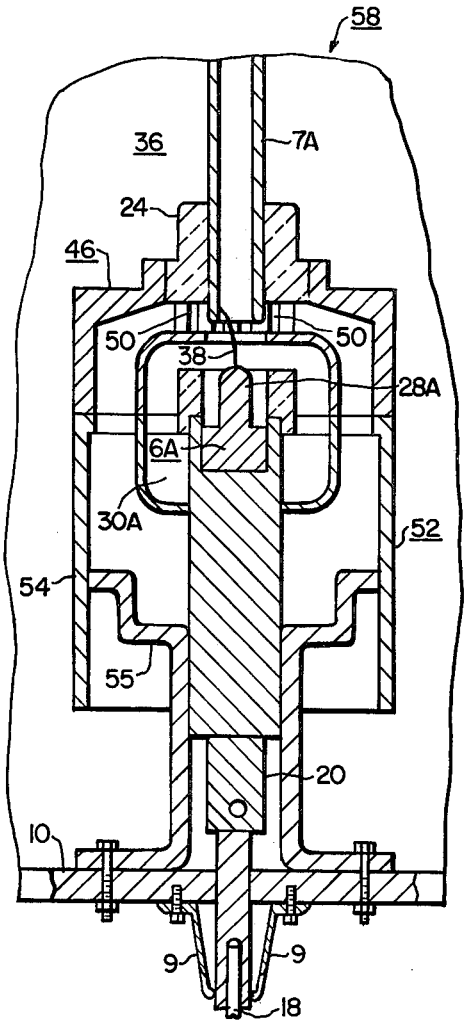
Figure 7A:
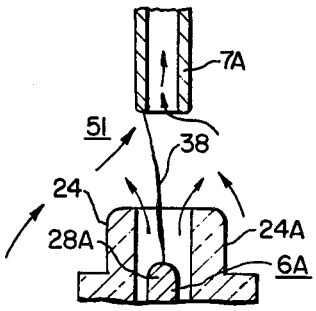
FIG. 7A is a fragmentary view of a latter position of the movable contact during the opening operation.
Figure 8:
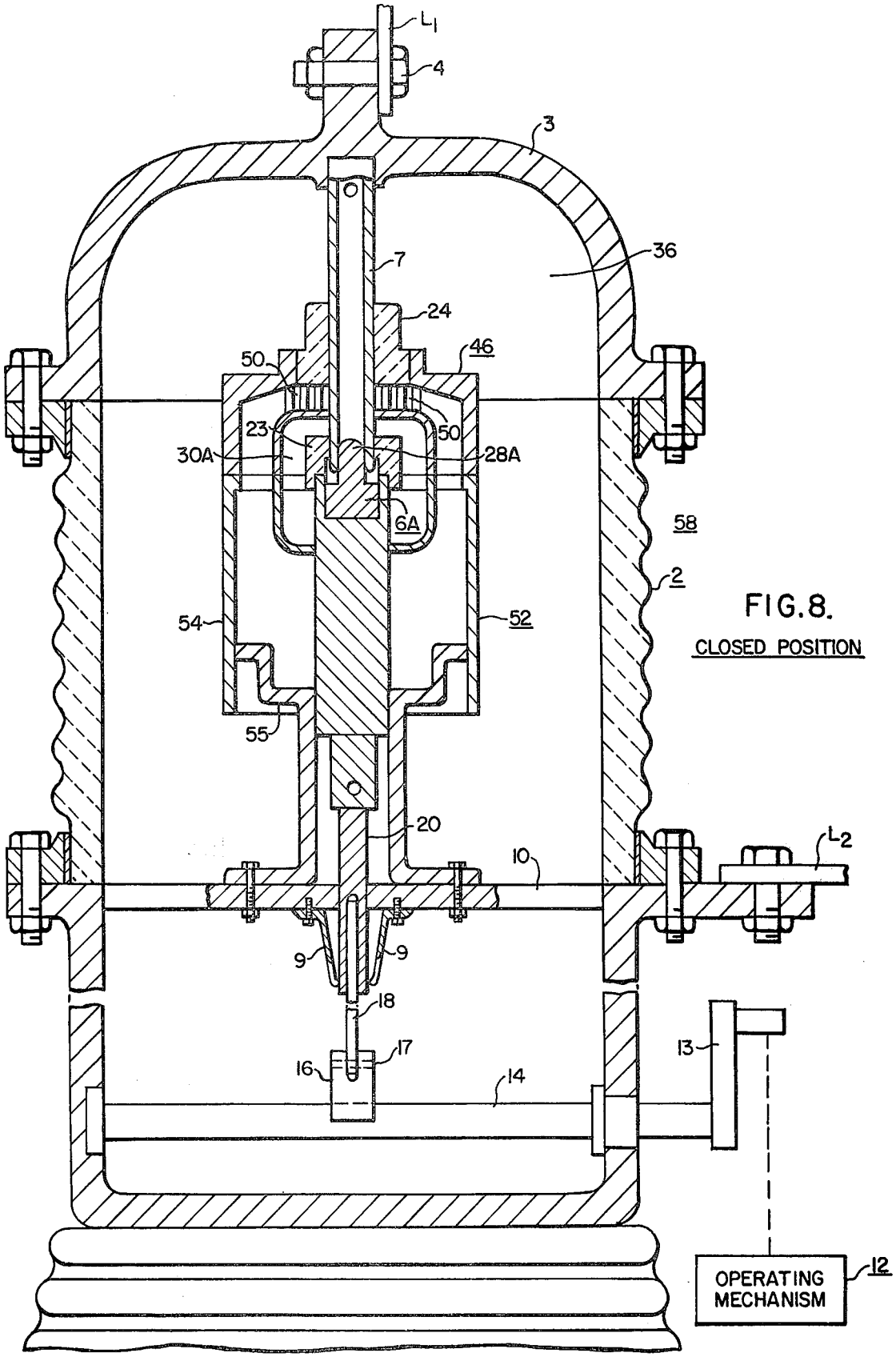
FIG. 8 illustrates a still further modification of the invention of FIGS. 6 and 7, wherein an auxiliary puffer device is included to assist in generating an augmenting flow of compressed gas; and, FIG. 9 shows the device of FIG. 8 in the partly-open-circuit position.

In the embodiment 58 of FIGS. 8 and 9, on the other hand, the arc-extinguishing gas 36, compressed by means of the puffer device 52 and the operation thereof, causes the arc-extinguishing gas to be raised in pressure, with the arc energy separately passing through the cooling grooves 50 provided within the cooling device, or heat sink 46 to effect thereby a subsequent extinction of the arc 38.

When the stationary and movable contacts are constructed in an opposite manner from those set forth above in each of the embodiments, as above-described and operated, a similar effect is, of course, obtained. Also, the volume of the gas-storage chamber 30 is determined by various conditions, such as the interrupting capacity of the circuit-breaker 1, the dimensions of the puffer cylinder 54, the dimensions of the several relatively-movable contact members 6, 7, etc.

Although there have been illustrated and described several embodiments of the invention, it is to be clearly understood that the same were merely for the purpose of illustration, and that changes and modifications may readily be made therein by those skilled in the art, without departing from the spirit and scope of the invention.

What is claimed is:

1. A gas-blast-type of circuit-interrupter including, in combination:

(a) means defining an outer gas-confining casing structure (2);

(b) means defining a substantially-enclosed arc-extinguishing unit (21) disposed interiorly within said outer gas-confining casing structure (2) having an orifice-opening (24*a*) provided in one wall portion thereof;

(c) means defining a relatively-stationary non-vented contact disposed within said interiorly-disposed substantially-enclosed arc-extinguishing unit (21);

(d) means defining a cooperable movable tubular venting contact (7) movable through said orifice-opening (24*a*) during the closing operation of the circuit-interrupter and into contacting closed-circuit engagement with said relatively-stationary non-vented contact (6) during the closing operation of said gas-blast-type of circuit-interrupter;

(e) operating means for causing the withdrawal of said movable tubular venting contact (7) out of contacting engagement with said relatively-stationary contact during the opening operation of the circuit-interrupter and out of said orifice-opening (24*a*) and away from said substantially-enclosed arc-extinguishing unit (21) to an isolated open-circuit position therefrom during the opening operation of the gas-blast-type of circuit-interrupter;

(f) said substantially-enclosed arc-extinguishing unit (21) additionally having an apertured, partition-plate means (34) associated therewith and dividing said substantially-enclosed arc-extinguishing unit into two separate sub-division gas chambers;

(g) one of said sub-division gas chambers being a gas-storage region (32) disposed generally rearwardly of said relatively-stationary non-vented contact (6) for the adjacent storage of gas under pressure generated during high instantaneous values of arcing current;

(h) the other sub-division gas chamber (27) providing an annular, inwardly, gas-directing gas-flow passage directing gas flow from said gas storage chamber (32) radially inwardly into the arcing region (29) located between the disposition of the relatively-stationary non-venting contact (6) and the upstream entrance opening of said orifice-opening (24*a*), whereby during the opening operation of the circuit-interrupter at a time when the tubular movable venting contact is disposed within the orifice-opening (24*a*), heated compressed gas, generated during high instantaneous values of arcing current, will be forced through said apertured partition-plate means (34) and stored within the first mentioned sub-division gas-storage region (32) to be confined therein until the time of relatively-low instantaneous values of arcing current, at which time said stored compressed gas within the gas-storage region (32) will flow, in a reverse fashion, through said partitioned plate-means (34) and through said gas-directing passage means into the arc established within said orifice opening (24*a*) and through said tubular vented contact 7 for arc-extinguishing purposes.

2. The combination according to claim 1, wherein an additional orifice structure (23) is provided surrounding the relatively-stationary non-vented contact (6), and spaced axially from the aforesaid orifice opening (24*a*) for additional arc-extinguishing action during circuit-interruption.

3. The combination according to claim 1, wherein means defining a metallic cooling structure is provided constituting a portion of the second-mentioned, inwardly gas-directing passage means (27) for cooling the stored gas not only during its initial gas-confining period, but also, additionally, at a later point of time when it is being directed into the arcing region (29) for additional arc-extinguishing action.

4. The combination according to claim 1, wherein the gas storage region (32) and the apertured partition-plate means (34) is formed of metallic material.

5. The combination according to claim 3, wherein said gas-cooling device comprising a radially-slotted metallic structure having a plurality of circumferentially-disposed cooling grooves (50) provided therein, through which cooling grooves (50) the compressed gas passes during its gas-storage movement and also during its reverse return arc-ejection gas-flow movement.

6. The combination according to claim 1, wherein the relatively-stationary contact structure (6) includes a relatively-stationary contact-plug portion (28) which enters the confronting open end of the movable tubular venting contact in the closed-circuit position of the circuit-interrupter.

7. A gas-blast-type of puffer circuit-interrupter including, in combination:

(a) means defining an outer gas-confining casing structure (2);

(b) means defining a movable substantially-enclosed arc-extinguishing unit (46) disposed interiorly within said outer gas-confining casing structure (2) and having a movable orifice-opening (24*a*) provided in one movable wall portion thereof;

(c) means defining a relatively-stationary tubular vented contact disposed within said outer gas-confining casing structure (2);

(d) means defining a cooperable movable non-vented contact (28) constituting a part of said relatively-movable substantially-enclosed arc-extinguishing unit (46);

(e) means defining a substantially-stationary piston structure (55);

(f) said movable substantially-enclosed arc-extinguishing unit including, additionally, a movable operating cylinder-portion (52) slidable over said relatively-stationary piston structure during the opening operation (55) for the compression of gas therebetween;

(g) said movable substantially-enclosed arc-extinguishing unit being subdivided by an apertured partition-plate means (34) into two adjacently-disposed gas-chambers;

(h) one of said gas-chambers being a movable gas-storage region (30) within which compressed gas, generated during relatively-high instantaneous values of arcing current, may be stored temporarily;

(i) the other movable gas chamber (27) directing gas flow from said first-mentioned gas-storage chamber (30) radially inwardly into the arcing region (29) located between the movable non-vented contact (6A) and the relatively-stationary tubular vented contact (7A);

(j) said compressed gas being ejected through the movable orifice-opening during the opening operation of the circuit-interrupter in a reverse-flow fashion from said movable compressed-gas storage-region (30); and, (k) the gas puffer chamber (56) being separated by a partition-plate portion from the gas-storage region (30) for auxiliary puffer assistance during relatively-low values of arcing current.

8. The combination according to claim 7, wherein said last-mentioned movable partition-means has one or more valve-controlled apertured openings provided therethrough to prevent ejection of compressed gas out of the gas puffer chamber (56) prior to a reduction of pressure within the movable gas-storage region (30).

9. The combination according to claim 7, wherein an additional movable insulating nozzle is provided axially spaced from the first-mentioned movable insulating orifice opening (24*a*) and surrounding the movable non-vented contact and assisting in arc-extinguishing action.

10. The combination according to claim 7, wherein a movable metallic cooling structure is provided within the first-mentioned movable subdivision gas-flow chamber (27) to cool the compressed gas first upon its storage within the movable gas-storage chamber (30) and then also subsequently cool it upon its reverse travel into the movable arcing chamber (29) located between the separable contact and adjacent the movable orifice opening (24*a*).

* * * * *